United States Patent [19]

Edlin

[11] 4,053,009

[45] Oct. 11, 1977

[54] SUSPENSION AND HEADING STIFFENER FOR CURTAINS, DRAPES OR THE LIKE

[76] Inventor: William Joel Reginald Edlin, P.O. Box 90, Katikati, New Zealand

[21] Appl. No.: 673,133

[22] Filed: Apr. 2, 1976

[30] Foreign Application Priority Data

Apr. 7, 1975 New Zealand ..... 177140

[51] Int. Cl.[2] ..... A47H 13/14

[52] U.S. Cl. ..... 160/348; 24/16 PB; 24/204

[58] Field of Search ..... 160/345-348, 160/330; 24/204, 208 A, 248 SL, 249 SL, 235 SL, 213, 214, 216, 217, 16 PB; 46/30, 31; 16/93 D, 94 D, 87 R, 87.2, 87.4, 87.6

[56] References Cited

U.S. PATENT DOCUMENTS

| | | | |
|---|---|---|---|
| 2,559,072 | 7/1951 | Hasselwander | 160/348 |
| 2,943,415 | 7/1960 | Viken | 24/204 |
| 3,359,592 | 12/1967 | Saltz | 16/93 D |
| 3,434,524 | 3/1969 | Fein | 160/345 |
| 3,729,780 | 5/1973 | White | 24/208 A |
| 3,823,443 | 7/1974 | Takabayashi | 24/255 SL |

FOREIGN PATENT DOCUMENTS

| | | | |
|---|---|---|---|
| 1,269,307 | 5/1968 | Germany | 160/348 |

*Primary Examiner*—Peter M. Caun
*Attorney, Agent, or Firm*—Robert E. Burns; Emmanuel J. Lobato; Bruce L. Adams

[57] ABSTRACT

A combination suspension and heading stiffener for a drape, curtain or like hanging which comprises an elongate member one portion of which is substantially more flexible than the other. The elongate member has attachment means whereby one such member can be coupled in an end to end relationship with another member. The elongate member is adapted to be coupled to a suspension means.

6 Claims, 9 Drawing Figures

SUSPENSION AND HEADING STIFFENER FOR CURTAINS, DRAPES OR THE LIKE

BACKGROUND OF THE INVENTION

This invention relates to an improved suspension and heading stiffener for curtains, drapes or the like.

It is always desirable to have curtains or drapes looking neat and tidy irrespective of whether they are drawn or pulled back. One method of achieving this is to have a heading tape with elastic pleating cord or cords and this method is widely used. While this method assists in keeping drapes or curtains tidy it does not provide positive control over the folds or pleats in the fabric. The heading tape also includes provision for the attachment of curtain hooks which fasten the curtain or drape to glides or runners set in or on tracks.

Accordingly, the present invention aims to provide a combined suspension and heading stiffener for curtains, drapes or the like which positively controls the folds in the material and enables the material to fall or hang in a regular fashion.

SUMMARY OF THE INVENTION

Broadly the invention consists in one aspect of a combination suspension and heading stiffener for a drape, curtain or like article comprising an elongate member one portion of the length of which is substantially rigid while the other portion is flexible, means for coupling the elongate member to suspension means, and means incorporated at one end of the elongated member for connection to cooperating means at the opposite end of another elongate member.

According to a second aspect there is provided a drape, curtain or like article in combination with a support track and a support comprising a plurality of elongate members of the type referred to in the first aspect joined together in end to end relationship, said support being attached to the drape, curtain or like article and each elongated member being coupled to guide means located with the support track.

DETAILED DESCRIPTION OF CERTAIN PREFERRED FORMS OF THE INVENTION

In more fully describing the invention is one of its preferred forms, the elongate member 10 is of a rectangular shape with one half 11 of its length being of a thicker cross-section than the other half 12. Accordingly the member is divided transversely into a substantially rigid half 11 and a flexible half 12. It is envisaged that the member will be injection moulded from a plastics material.

Figure 6:
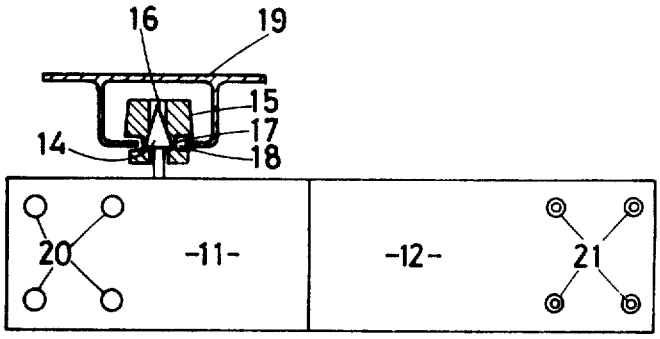
FIG. 6 is a face view of the member of FIG. 1 when suspended by a curtain track.

An upstanding spike 13 having an enlarged head 14 projects from one long edge of the rigid portion 11. The spike 13 forms a suspension portion and is configured to be push fit into a central opening 16 in a glide 15 (see FIG. 6). The diameter of the opening 16 is less than the greatest diameter of the head 14 so the head locks into the glide. The glide 15 is provided with a peripheral groove 17 which engages in between opposing edges of the slot 18 of an extruded guide channel 19. The diameter of the peripheral groove 17 is less than the width of the slot 18 so that the glide 15 can rotate in the slot.

Of course the spike can take other forms, such as a hook, which can be attached to the glide or runners of any known type of curtain track. Alternatively, the enlarged head of a spike can simply fit into a slot in a guide channel.

Figure 1:
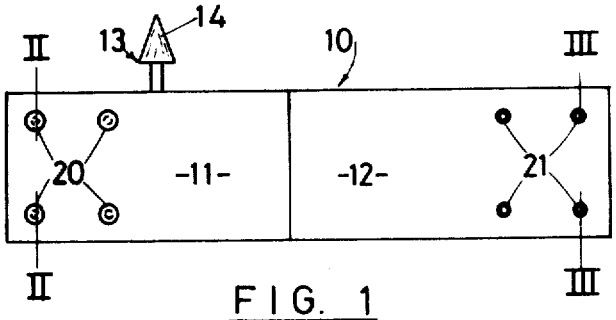
FIG. 1 is a face view of the combination suspension and heading stiffener member according to the present invention.
Figure 2:
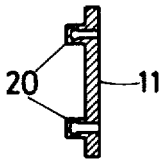
FIG. 2 is a section on line II-II of FIG. 1.
Figure 3:
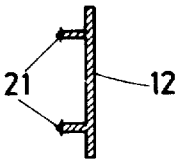
FIG. 3 is a section on line III-III of FIG. 1.
Figure 4:
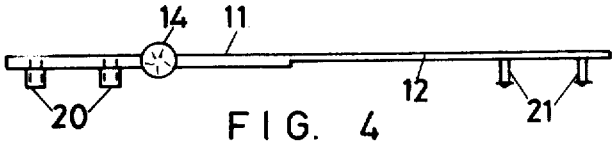
FIG. 4 is a top view of the member shown in FIG. 1.
Figure 5:
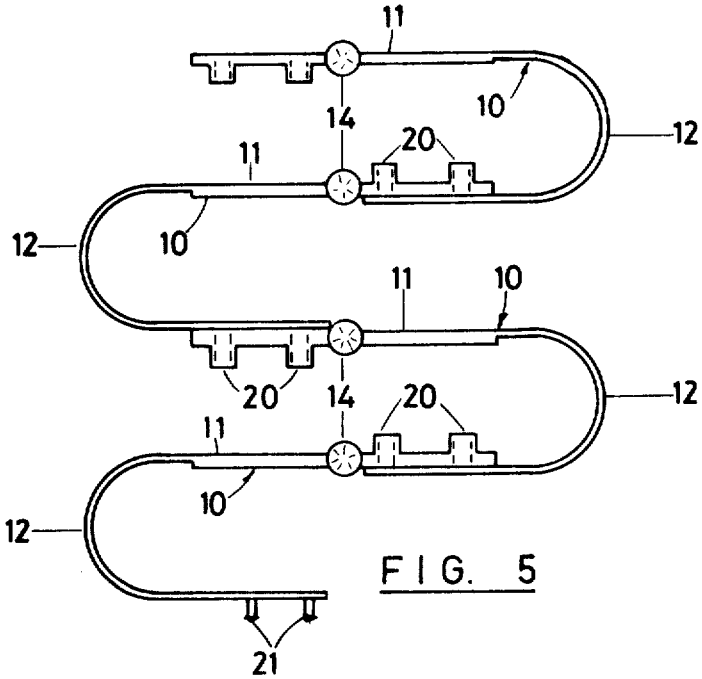
FIG. 5 is a top plan view of a number of the members of FIG. 1 joined together.

A series of sockets 20 (preferably four evenly spaced sockets) are formed in the thicker half 11 of the elongate member 10 and these are shaped to cooperate with a similarly disposed series of pins 21 on a second elongate member 10 (see FIG. 5). Accordingly, the pins 21 are formed and project from the surface of the thinner half 12 of the member 10. The pins 21 and sockets 20 project from the same face of the member 10 and are formed so as to snap fit together.

Figure 9:
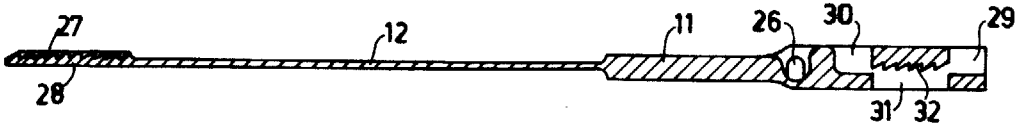
FIG. 9 is a top view of the member shown in FIG. 8.
Figure 8:
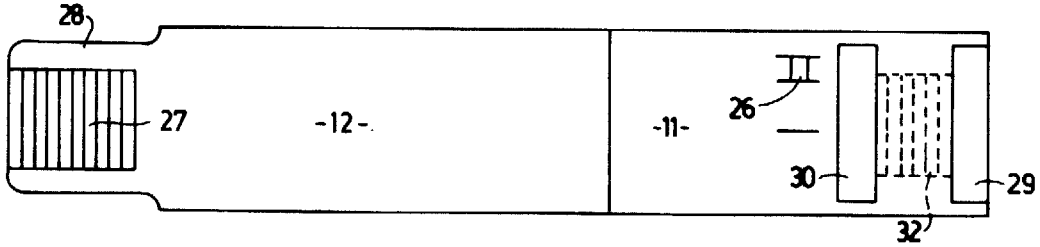
FIG. 8 is a face view of a second form of the combination suspension and heading stiffener.

According to the second form of the invention shown in FIGS. 8 and 9, the sockets and pins are replaced by means for adjustably connecting one member to another. In this form where parts corresponding to the first form carry the same reference numerals, the free end of the thinner portion 12 is provided with a series of transverse saw teeth formations 27. Conveniently these teeth 27 are formed on a tab portion 28 extending from thin portion 12. The free end of thick portion 11 is formed with a passageway having an entry 29 an exit 30 and an intermediate opening 31 which is opposite a series of transverse saw teeth formations 32. These teeth 32 slope in an opposite direction to the teeth 27 so that the teeth 27 of another member can freely move through the passageway but not return. The member 10 according to this form includes an edge opening aperture 26 instead of the headed spike 13 employed in the first form.

In use a number of members 10 according to the first form are fitted end to end by inserting the pins 21 into adjacent sockets 20 until a required length is obtained. With members 10 of the second form the tab 28 of one member is inserted into opening 29 of a second member and passed across the teeth 32 so that they engage with teeth 27 until the outer end of the tab 28 engages on ledge 33 of opening 29. If for any reason the tab 28 needs to be withdrawn the tab is flexed to bow into opening 31 so that the teeth 27 and 32 do not engage and then tab 28 can be withdrawn from the opening 29. The assembled length can then be inserted through a suitably sized top hem 23 in the curtain or drape material 24 by applying a slight pressure to force the pointed head 14 of the spike 13 of each member through the material. The aforementioned glide button 15 is then fitted onto the spike 13 and the whole assembly is mounted in a guide channel 19. If required, draw cords may be used. As the curtain or drape, so suspended, is folded back the flexible portions 12 bend into a curved shape which forms, with the interconnecting rigid portions 11, a series of well proportioned and neat folds in the material. The folds become narrower and closer together as the material is further bunched, however, the folds or pleats remain well formed and evenly spaced. The configuration of the members when the curtain or drape is pulled back is shown in FIG. 5.

The invention is open to modification as will be apparent to those skilled in the art. For example the glide 15 can be provided with a downwardly depending spike which fits into an edge opening aperture such as shown at 26 in FIGS. 8 and 9 in the thick portion 11 of the member 10. In this form the members 10 can be more readily inserted in a hem on the top edge of the curtain or drape. As will be appreciated the spike in this form would be firmly retained in the aperture in the member so as to support the weight of the hanging curtain or drape.

Figure 7:
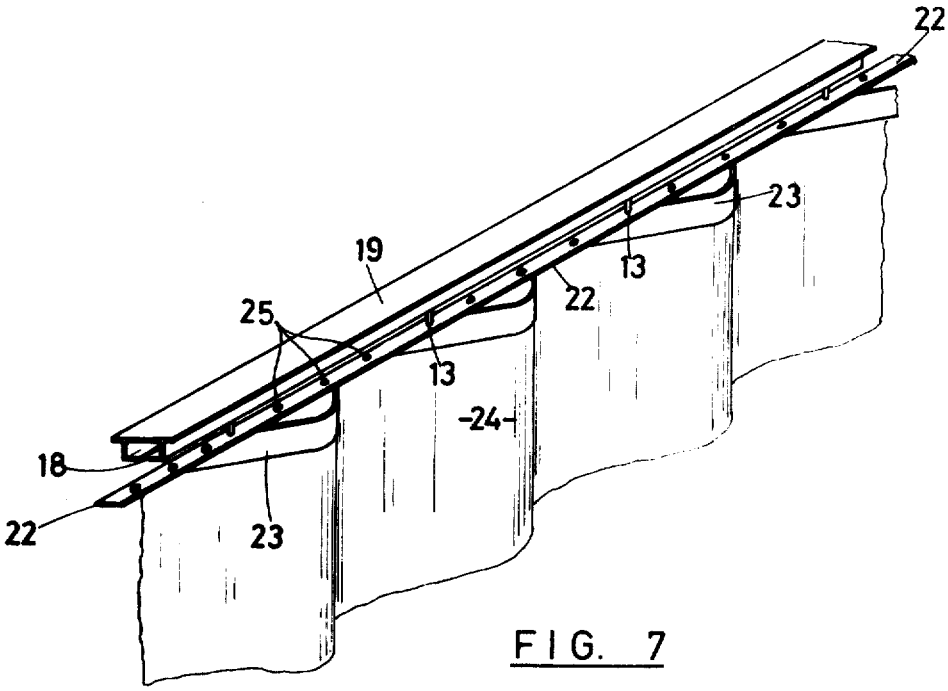
FIG. 7 is a perspective view of a number of the members joined together and supporting a curtain or drape from a curtain track.

In FIG. 7 there is shown a tie 22 which is used to prevent the curtain or drape from being completely drawn. This ensures that even when the curtain or drape is drawn across, there are still folds which are regular and symmetrical. The tie 22 is a light flexible plastics strip which has a series of regularly spaced apertures 25 through which the spikes 13 can be inserted. Accordingly, the tie 22 extends from spike to spike and in one form the intervals between the apertures 25 are less than the length of a member 10 (e.g. about two-thirds of the length) so that the line of connected members is prevented from completely straightening out. As shown in FIG. 7 however the tie 22 is provided with a series of closely spaced apertures 25 so that the extent of movement of the connected members can be adjusted. Also as shown in FIG. 7 the tie 22 is outside the hem 23 of drape 24 or alternatively joining the actual glides. The tie is supplied as a continuous length and then cut to the desired length.

According to yet another form of the invention the member can be provided with hooks or other fasteners which can engage with a drapery strip sewn to the top edge of the curtain or drape material. In this form there is not need for a hem on the curtain or drape material.

The invention thus provides a means of achieving positive control over the folds in a curtain, drape or like hanging. The folds stay consistently regular and symmetrical from top to bottom regardless of whether the drapes or curtains are drawn across a window or doorway or pulled back to the sides.

What is claimed is:

1. A combination suspension and heading stiffener for a drape, curtain or like article comprising: an elongate member of substantially uniform width throughout its length and having one end portion thicker than the other end portion so that said one end portion is substantially rigid whereas said other end portion is flexible; means disposed at a longitudinal edge portion of said elongate member for suspending it during use from suspension guide means; and means at one end of said elongate member for connecting with cooperating means at the other end of another similar elongate member to enable connection together of a plurality of such elongate members in end to end relationship.

2. A combinationsuspension and heading stiffener as claimed in claim 1; wherein the thicker portion of said elongate member has a hole therein opening at or adjacent a longitudinal edge thereof whereby a spike depending from the suspension guide means can be engaged therein to provide the means for supporting said elongate member from the suspension guide means; wherein the free end of the thin portion is of a reduced width, and a series of transverse saw-teeth formations being provided on the face of the reduced width portion; and wherein the thick portion is provided with an end opening aperture on a face opposingly directed to the face on which the saw-teeth formations of the reduced width portion are formed, and a second series of transverse saw-toothed formations being provided within said aperture, said saw-teeth of the reduced width portion being inclined in an opposing sense to those of the thick portion such that the aperture can receive therein the reduced width portion of another elongate member such that the saw-teeth formations interengage enabling the elongate members to be joined together in end to end relationship.

3. In combination with a drape, curtain or like article and support track therefor; a curtain support comprising a plurality of elongate members each configured as set forth in claim 1 and each elongate member having at least two sockets at one end portion and an equal number of pins at the other end portion thereof, and said elongate members being joined in end to end relationship by said pins of one elongate member being inserted in respective ones of said sockets of another elongate member, each elongate member also having a spike extending from a longitudinal edge of the thick portion thereof capable of engaging the suspension guide menas to provide the means for supporting the elongate members therefrom; and a tie comprising a flexible strip having a plurality of apertures along its length and having the spikes of said elongate members inserted into selected apertures.

4. In combination with a drape, curtain or like article and support track therefor; a curtain support comprising a plurality of elongate members each configured as set forth in claim 2 joined together in an end to end relationship; and a tie comprising a flexible strip having a plurality of apertures along its length and located through selected ones of which are depending spikes formed on suspension guide mounted on a track and located in the apertures of the elongated members.

5. The combination according to claim 4; wherein the distance between the selected apertures of the tie is less than the distance between the apertures of the elongate members.

6. The combination according to claim 5; wherein the plurality of joined elongate members are located in a hem of the upper edge of the drape, curtain or like article and the spikes of the suspension guides pass firstly through the selected apertures of the tie and then through the material of the hem before being located in the apertures of the elongated members.

* * * * *